US007574785B1

(12) United States Patent
Chen

(10) Patent No.: US 7,574,785 B1
(45) Date of Patent: Aug. 18, 2009

(54) BUCKLING FASTENING DEVICE FOR LUGGAGE

(76) Inventor: Shou-Mao Chen, 344, Section 1, Chung Shan Road, Ta Cha Township, Taichung Hsien (TW)

( * ) Notice: Subject to any disclaimer, the term of this patent is extended or adjusted under 35 U.S.C. 154(b) by 269 days.

(21) Appl. No.: 11/556,983

(22) Filed: Nov. 6, 2006

(51) Int. Cl.
*A44B 11/25* (2006.01)

(52) U.S. Cl. ..... 24/606; 24/265 B; 383/70; 383/71

(58) Field of Classification Search ..... None
See application file for complete search history.

(56) References Cited

U.S. PATENT DOCUMENTS 2,992,467 A * 7/1961 Gaylord ..... 24/606
6,640,400 B1 * 11/2003 Chen ..... 24/651

* cited by examiner

*Primary Examiner*—Jack W. Lavinder
(74) *Attorney, Agent, or Firm*—Egbert Law Offices PLLC

(57) ABSTRACT

This invention is a buckling fastening device of luggage including a strap clasp, a main casing, a prop block, a spring and a base casing. The main casing is a hollow trough with an expanded plate at its top. The expanded plate has an insert trough, and the prop block is located within the hollow trough. The spring is set between the prop block and the base casing. The base casing is set at the outer rim of the main casing, and its top plate has a ring corresponding with that of the main casing. The insert ends at the both sides of the strap clasp can block and fasten the clasp when inserted into the hollow trough of the main casing. By pressing the block ends, the clasp can be readily detached. Hence, the purpose of quick and convenient function is achieved.

7 Claims, 10 Drawing Sheets

BUCKLING FASTENING DEVICE FOR LUGGAGE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a buckle-fastening device of luggage, and more particularly to a device with elastic fastening function and contractible strap, which can achieve the purpose of convenient assembly and quick decoupling.

2. Description of Related Art Including Information Disclosed Under 37 CFR 1.97 and 37 CFR 1.98

A fastening clasp is attached to conventional luggage for the quick and convenient attachment of exterior stuff. The current clasp 72 (see FIG. 9) comprises a strap sewed on the luggage 70, which can sway randomly when there is no attachment, being exposed to potential damage and looking improper.

Referring to FIGS. 10 and 11, there is the prior art buckle fastening device. The prior art device is comprised of strap clasp 80, main casing 90, prop block 94, interior base plate 95, spring 96 and base casing 97, in which the strap clasp 80 forms an L-shape insert end 81 with a bulging rim 82 on the other side. The main casing 90 has a hollow inner trough 91, on top of which there is an expanded plate 92 with a bore 93. The prop block 94 is set in the hollow inner trough 91 and fixed by the interior base plate 95. The spring 96 is located between the prop block 94 and the interior base plate 95, pushing the prop block 94 upward. The base casing 97 has an inner groove 971 to fit into the outer rim of the main casing 90. The base casing 97 has an expanded rim 972 to fit with the expanded plate 92 of the main casing 90, which can easily fit into the wallboard of the luggage 98. The insert clasp 81 enters the inner trough 91 of the main casing 90, and is blocked at the base rim of the bore 93 by the bulging rim 82. Pushed by the prop block 94, the strap clasp 80 is fixed accordingly. When detaching the strap clasp 80 from the main casing 90, only the expanded plate 92 is exposed at the surface of the luggage, therefore avoiding accidental damages.

However, if the user is not familiar with the assembly of the L-shape insert clasp 81, the end of the insert clasp 81 and the bulging rim 82 are easily blocked by the expanded plate 92 at the bore 93, making it difficult to detach the insert clasp.

Therefore, a new invention of the buckle fastening device is called for on this aspect.

BRIEF SUMMARY OF THE INVENTION

This invention intends to propose an improved buckle-fastening device, which comprises of a strap clasp, a main casing, a prop block, a spring and a base casing. The strap clasp has an insert end at both end, which has a press component and a block end. The insert ends are inserted into both sides of the strap clasp. As there is a spring between the two block ends, the block end will prop up. There is a hollow trough within the main casing with an expanded plate at the top. There is a bore on the expanded plate. The prop block is set within the hollow trough and its prop plate matches with the bore of the main casing. The spring is set between the prop block and the base plate of the main casing, pushing the prop block upward. The base casing has a groove to fit into the outer rim of the main casing. The upper plate of the base casing has an expanded rim, which can fit into the wallboard of the luggage. In this invention, only the plate of the main casing is exposed. The strap clasp can enter the shallow trough via the bore, and is blocked at the base rim of the bore by its block end. Then it is fixed by the prop block. By pressing the press component on both sides and forcing the block end to contract inward, the strap clasp can directly move out of the main casing, and hence detached from the luggage.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
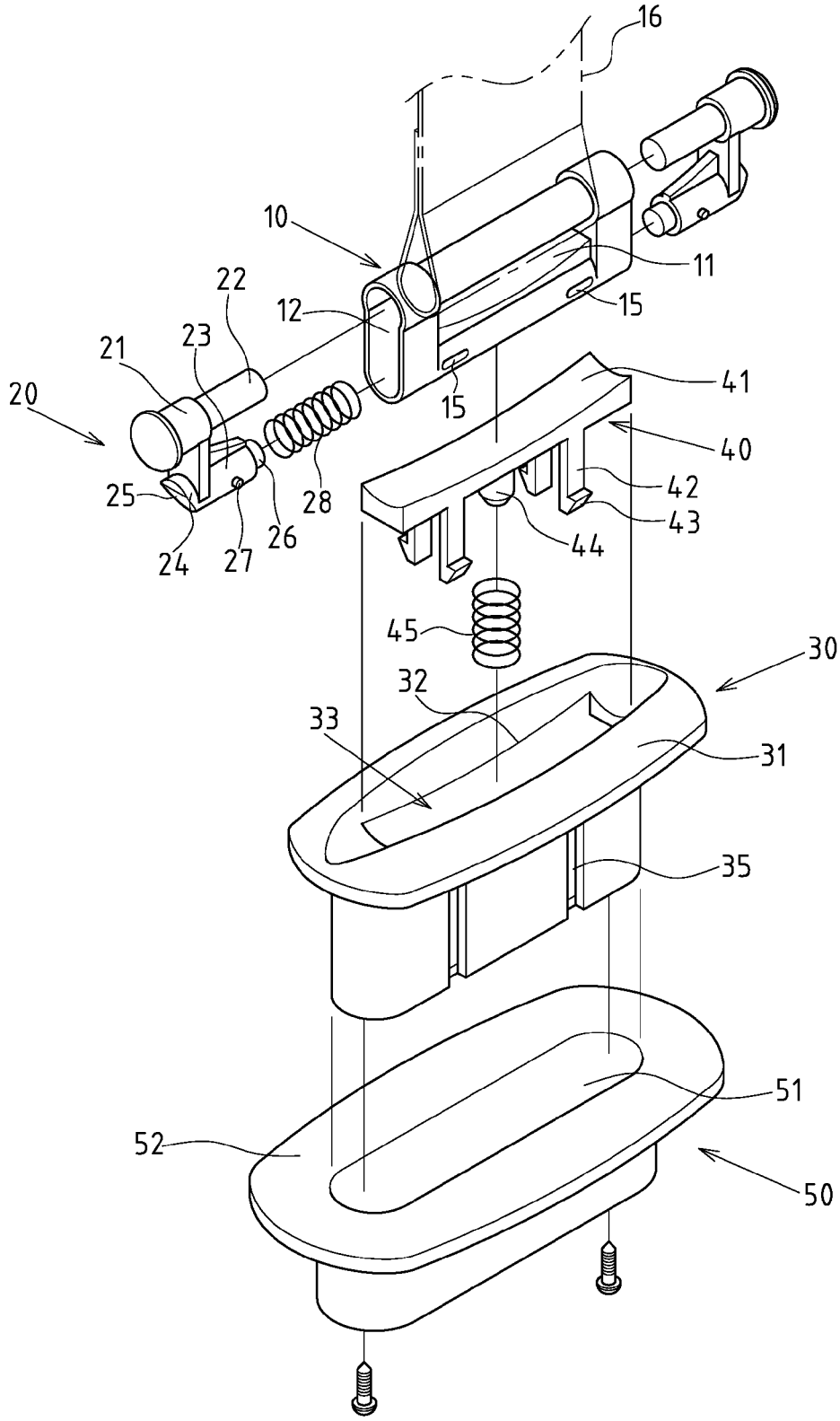
FIG. 1 shows an exploded perspective view of the present invention.
Figure 2:
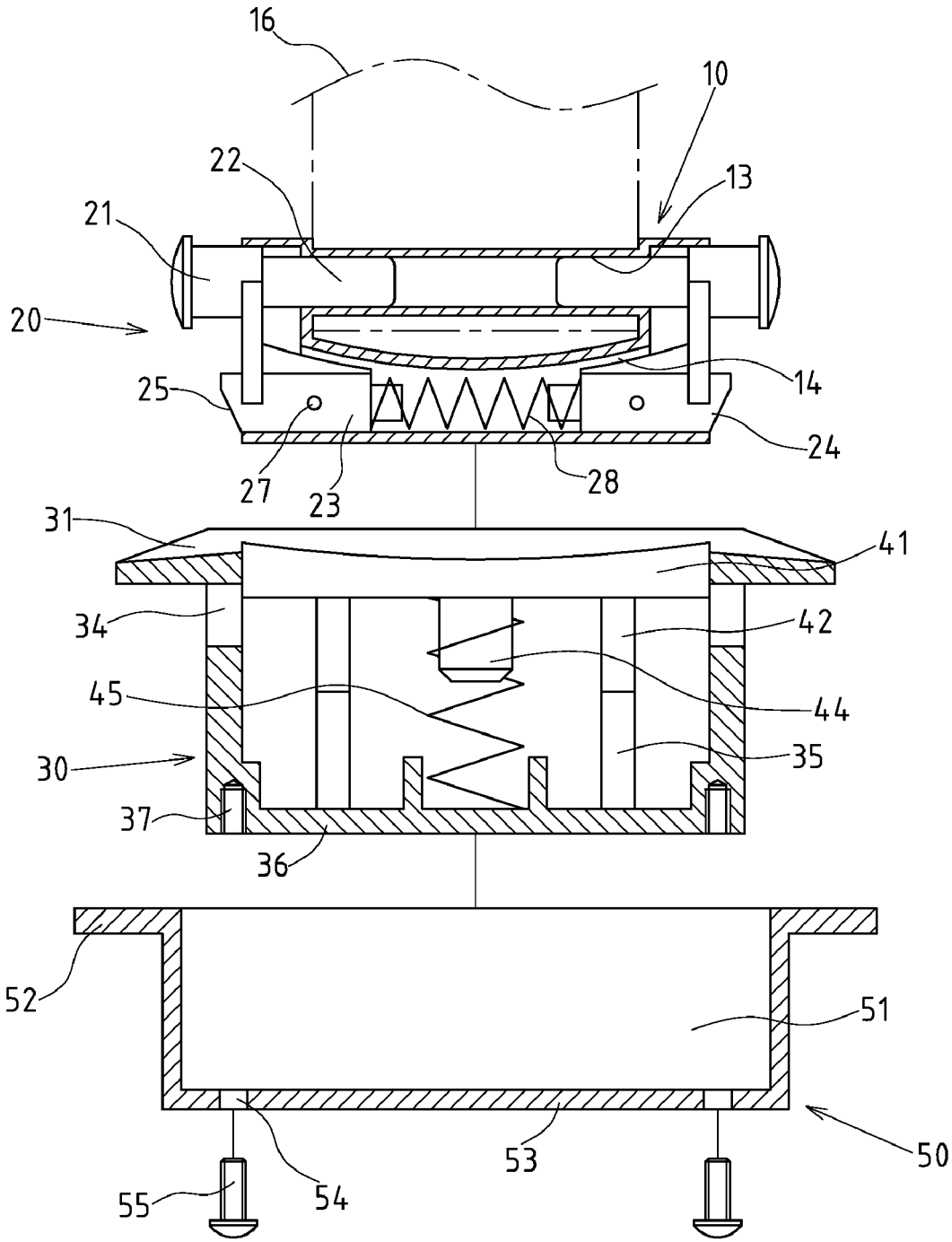
FIG. 2 shows a sectional view of the present invention.

As shown in FIGS. 1 and 2, the embodiment of the present invention comprises a strap clasp 10, at the center of which there is a long bore 11 to allow the strap 16 to move through it. Both ends of the strap clasp 10 have an insert trough 12 respectively, in which there are an upper trough 13 and a lower trough 14. At the bottom of the strap clasp 10, at least one end has two long troughs 15. The insert trough 12 has an insert end 20, which is comprised of a press component 21. The press component 21 has an insert end 22 and is connected with a block device 23. The block device 23 has a block end 24, an inside protruding pole 26, and an outside protruding pole 27. The insert end 22 and the block device 23 are inserted respectively into the upper and lower troughs 13, 14. There is a spring 28 set between the block device 23 and the protruding pole 26, which makes the protruding poles 27 of the two block devices 23 inserted into the troughs 15 of the strap clasp. The press component 21 and the block end 24 also partially reach into the insert trough 12.

The invention also includes a main casing 30, which has a hallow trough 33. It has an expanded plate 31 at the top, which has an insert trough 32 reaching into the hallow trough 33. There is a bore between the bottom rim of the insert trough 32 and the main casing 30. Two vertical guide channels 35 are located at both sides of the main casing 30.

A prop block 40 has a cursive top plate 41 at the top. The top plate 41 has protruding poles 42 at its bottom. A lower part of the protruding pole 42 protrudes outside and forms a hook 43. The prop block 40 is set within the hallow trough 33 of the main casing 30 via the insert trough 32. The top plate 41 of the prop block 40 can fit with the insert trough 32 of the main casing 30, and its hooks 43 can fit into the guide channels 35 of the main casing 30.

A spring 45 is placed between the prop block 40 and the base plate 36 of the main casing 40, pushing the prop block 40 upward to reach the bottom of the strap clasp 10. The spring can make the top plate 41 of the prop block 40 prop up to form a bulging part 44, where the spring 45 can be fastened.

A base casing 50 has an inner groove 51 to fit the bottom of the main casing 30. There is an expanded rim 52 at the top of the base casing 50. There are bore 54 and screw 37 on the base plate 53 of the base casing 50 and the base plate 36 of the main casing 30 to fix them by bolts 55 on the wallboard 61 of the luggage 60.

Figure 3:
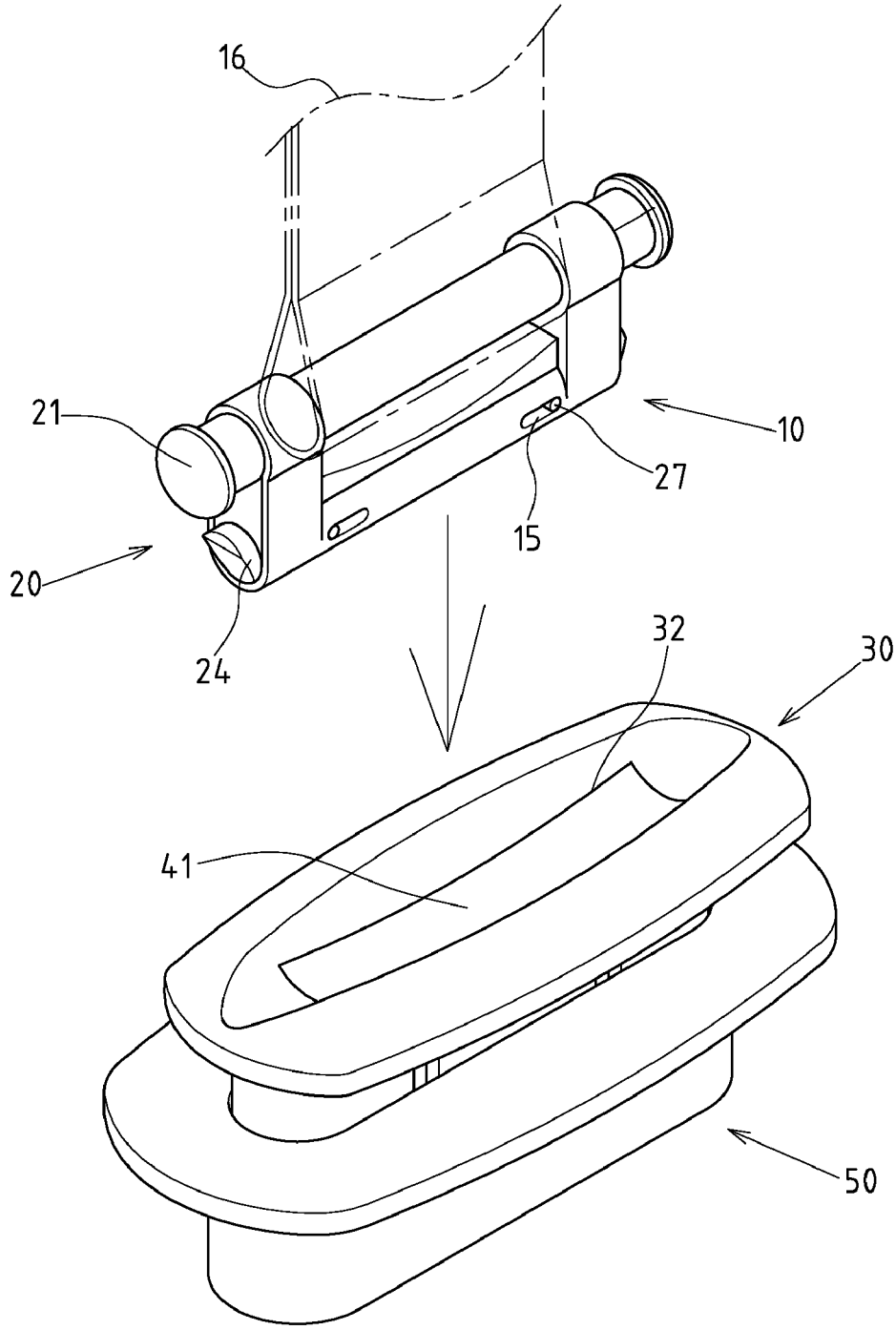
FIG. 3 shows a flow chart of assembly steps of the strap clasp of the present invention.
Figure 4:
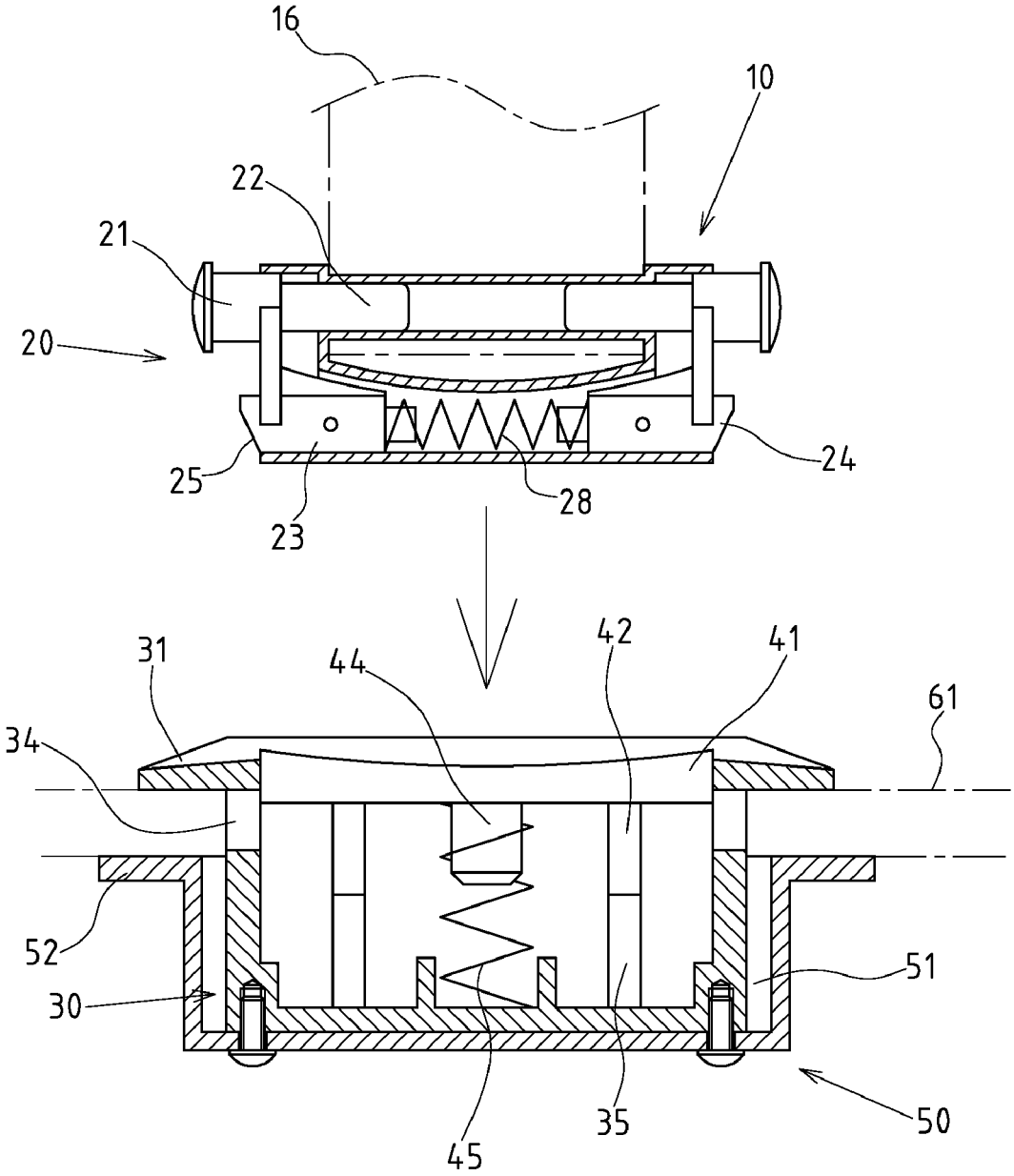
FIG. 4 shows a sectional view of the assembly steps of the strap clasp the present invention.
Figure 5:
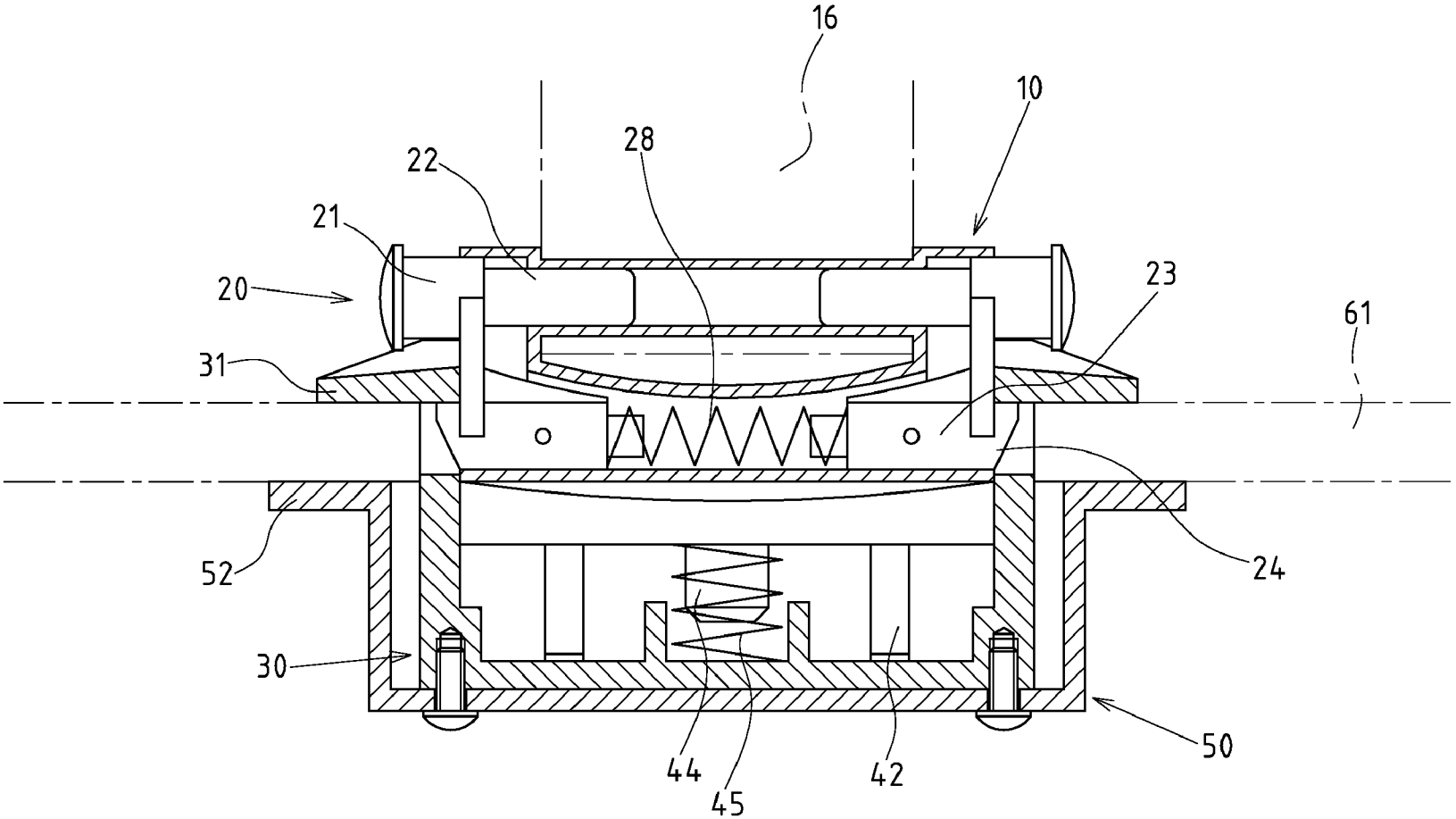
FIG. 5 shows a sectional view of the assembled state of the present invention.

FIGS. 3, 4 and 5 depict the fastening function of the proposed strap clasp 10. By inserting the strap clasp 10 into the insert trough 32 of the main casing 30, it will push the bevel face 25 of the block end 24 of the insert end 20 inward, and reach the hallow trough 33. The reverting force of the spring 28 then pushes the block ends 24 to reach the bores 34 at the bottom of the insert trough 32, fastening the strap clasp 10 accordingly. On the other hand, the strap clasp 10 will push the prop block 40 downward and make the spring 45 accumulate the elastic force and push upward, making the fastening tight and sound.

Figure 6:
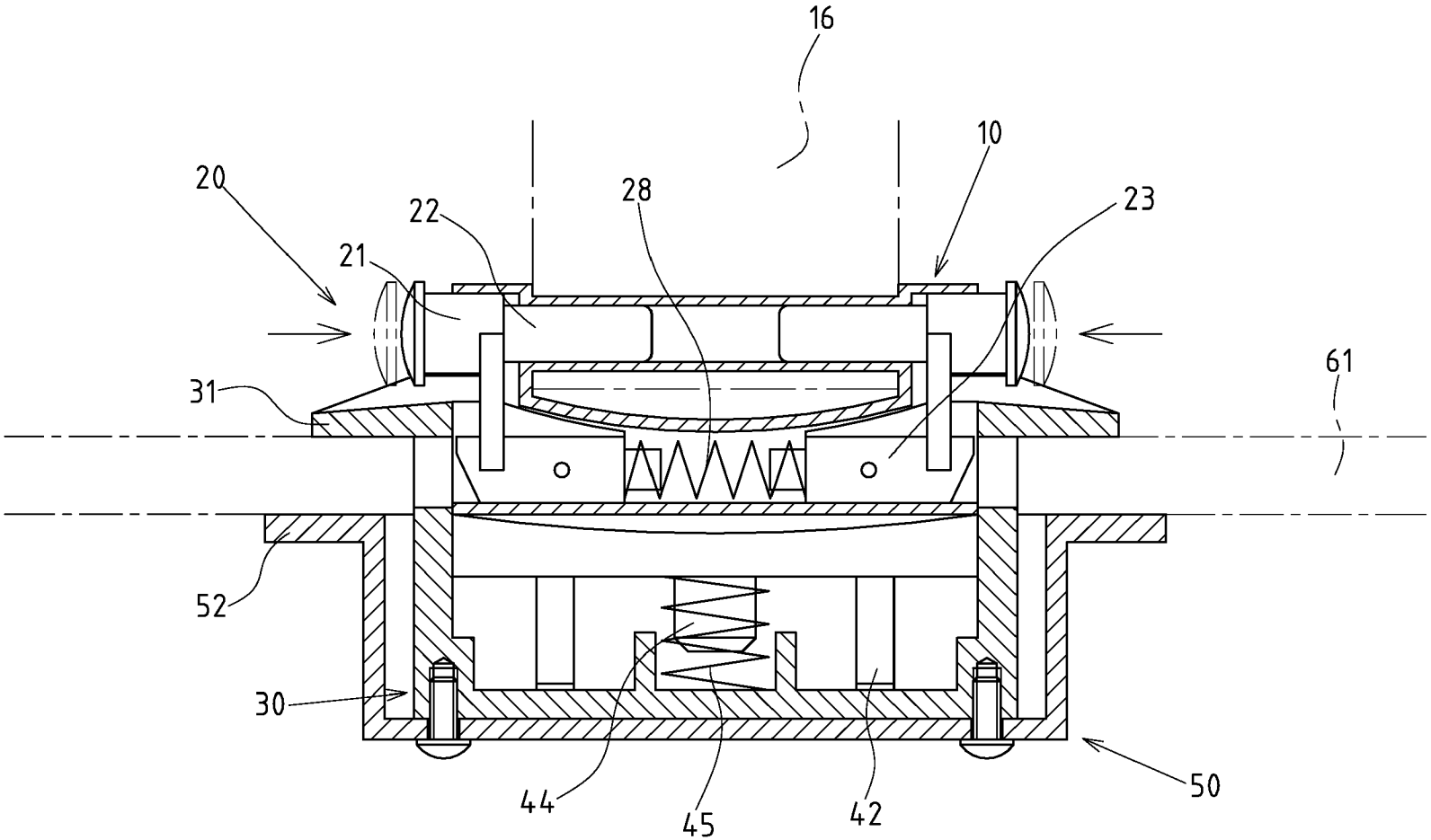
FIG. 6 shows a sectional view of the dissembled state of the present invention.

FIG. 6 depicts the detaching function. The press component 21 is pressed on both sides and the block ends 24 are loosened, then the strap clasp 10 is moved out from the insert trough 32 to complete the detaching action. As the strap clasp 10 moves out of the main casing 30, the prop block 40 at the bottom will be pushed upward by the spring 45, making its top face 41 in line with the top face of the main casing's plate 31.

Figure 7:
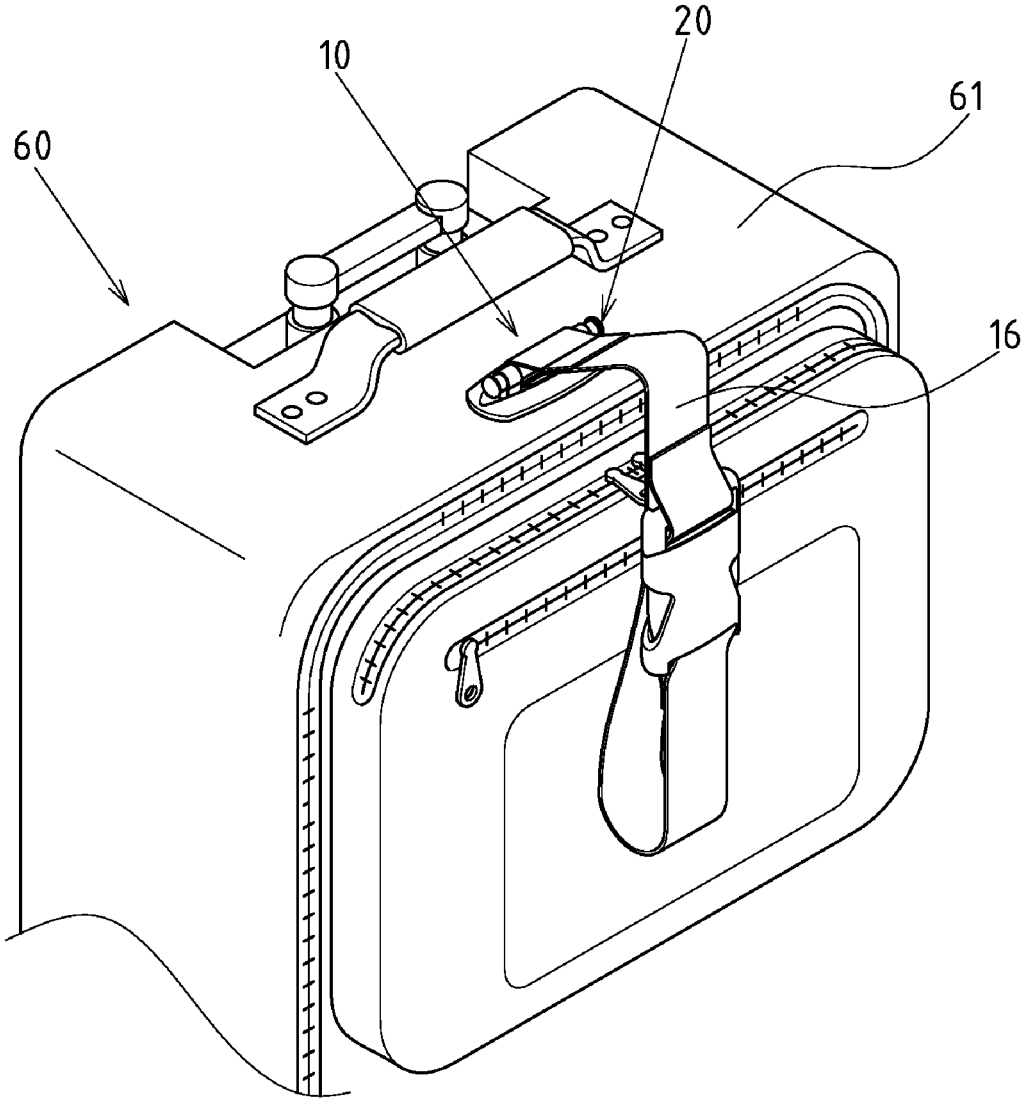
FIG. 7 shows a perspective view of a diagram of the installation of the present invention on luggage.

FIG. 7 depicts the installation of the present invention on the luggage.

Figure 8:
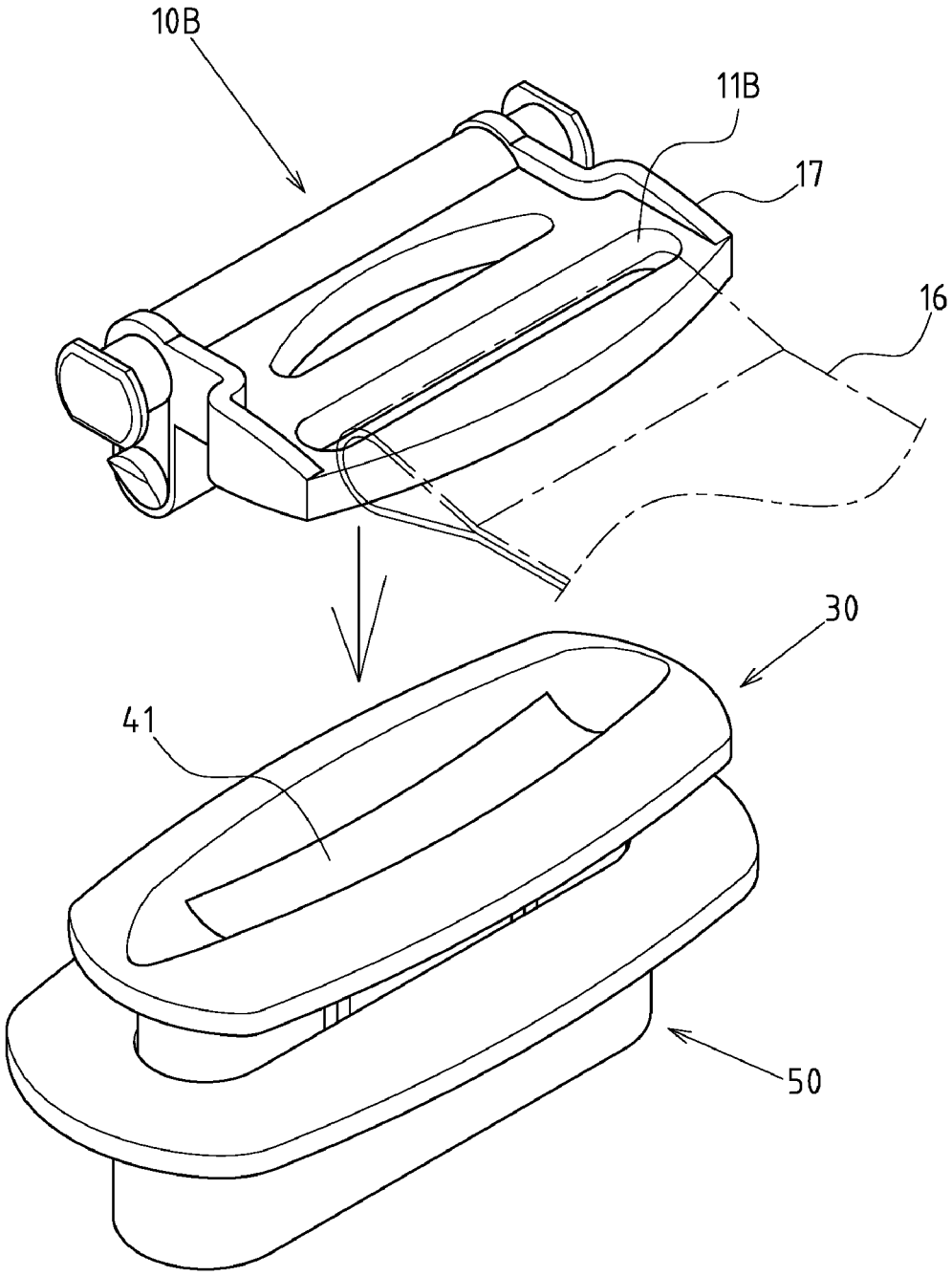
FIG. 8 shows a perspective view of another embodiment of the strap clasp of the present invention.
Figure 9:
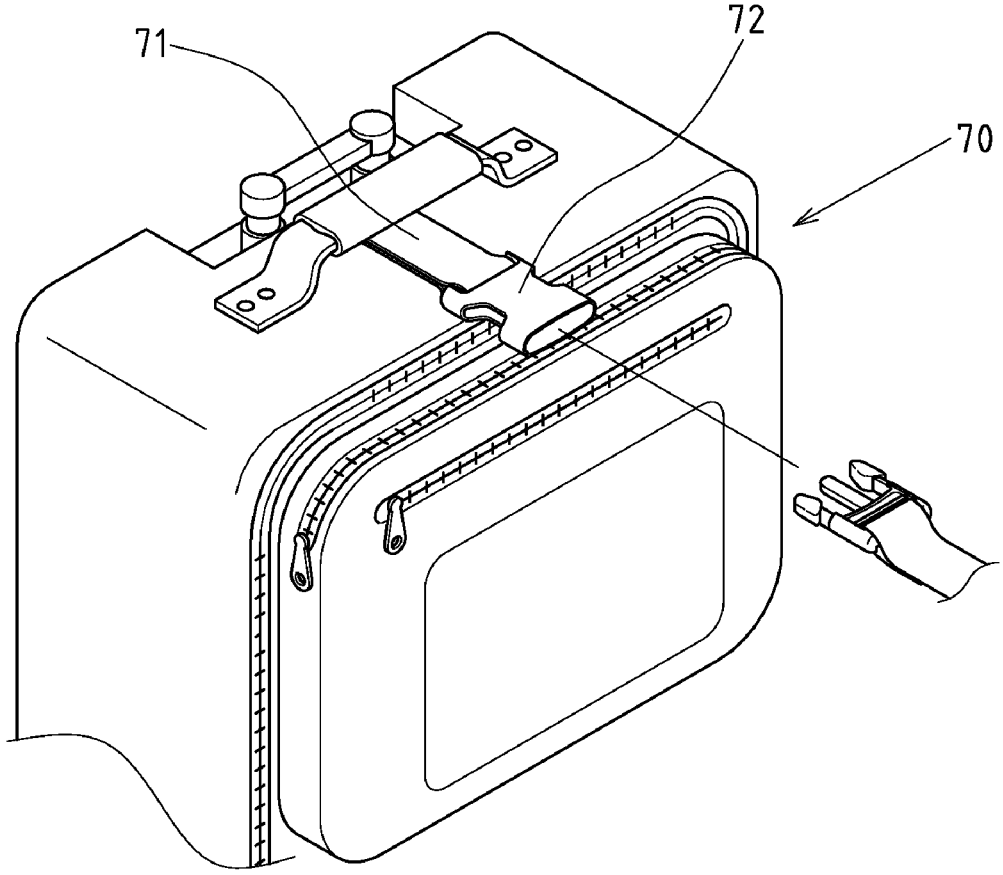
FIG.9 PRIOR ART
FIG. 9 shows a perspective view of an external view of the prior art structure.
Figure 10:
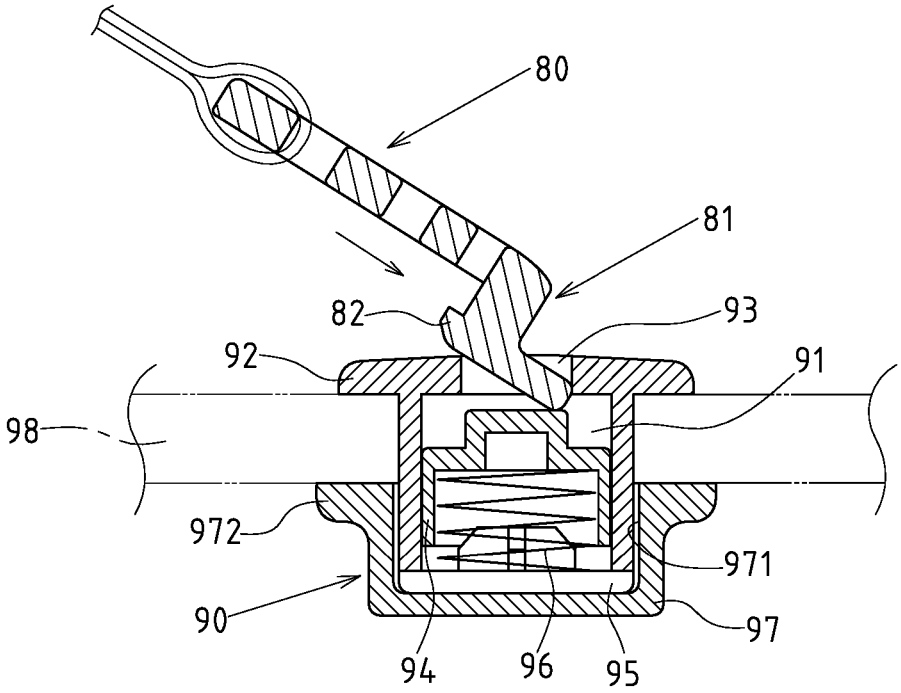
FIG.10 PRIOR ART
FIG. 10 shows a sectional view of the prior art structure and fastening steps of the strap clasp.
Figure 11:
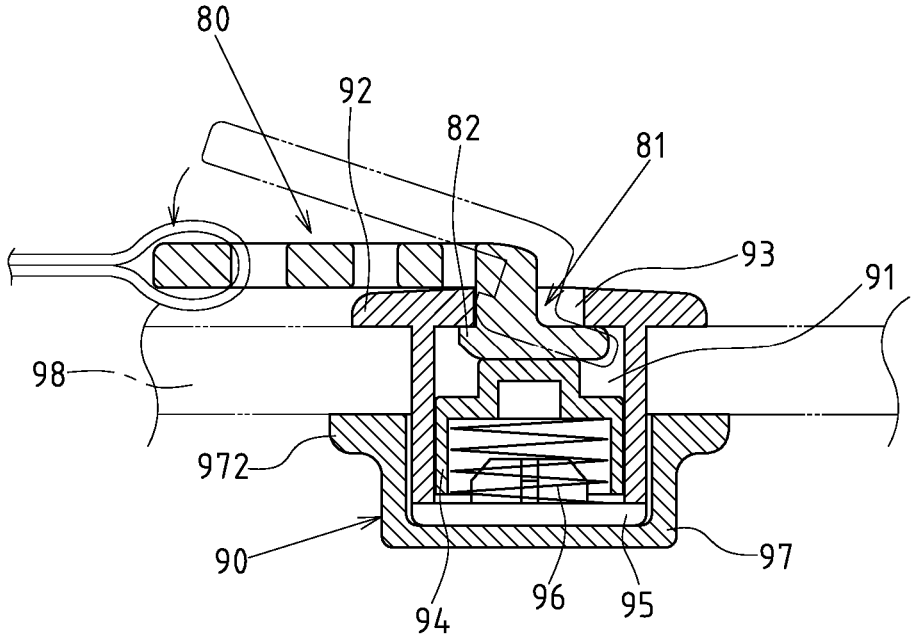
FIG.11 PRIOR ART
FIG. 11 shows a schematic view of a diagram of the fastening of the strap clasp, based on FIG.

FIG. 8 depicts another embodiment of the present invention. The strap clasp 10B has an extra-extended part 16, which has a long bore 11B to allow the strap 16 to move through.

The operation of the invention is described herein. As the insert the strap clasp is directed downward into the insert trough of the main casing, the insert ends on both sides will be pressed inward and then blocked at the both sides of the bottom part of the insert trough to achieve the fastening purpose.

The press component is pressed on both sides of the strap clasp, forcing the block ends at its bottom to move inward. The strap clasp is vertically detached from the insert trough.

As the strap clasp is fixed, the prop block can make the fastening convenient and secure.

Although the invention has been explained in relation to its preferred embodiment, it is to be understood that many other possible modifications and variations can be made without departing from the spirit and scope of the invention as hereinafter claimed.

I claim:

1. A buckle fastening device for luggage comprising:

a strap clasp having an insert end with elastic propping parts at both sides thereof;

a main casing having a hollow trough, said main casing having an expanded plate at a top thereof, said expanded plate having an insert trough opening to said hollow trough, said insert trough having a bottom rim through which said hollow trough extends;

a prop block set within said hollow trough of said main casing, said prop block having a top plate fit into said hollow trough of said main casing;

a spring positioned between said prop block and a base plate of said main casing, said spring urging said prop block upwardly toward a bottom of said strap clasp;

a base casing having an inner groove receiving a bottom of said main casing, said base casing having an expanded rim at a top thereof, said base casing having said base plate with a bore therein, said base plate of said base casing aligned with said base plate of said main casing, the insert end of said strap clasp having the elastic propping parts being pressed inwardly and said insert trough being blocked when said strap clasp is inserted directly downwardly into said insert trough of said main casing, said strap clasp having an upper trough at one end thereof and a lower trough at an opposite end thereof.

2. The buckle fastening device of claim 1, further comprising:

a press component having an insert end and being connected to a block device, said block device having a block end and an inside protruding pole and an outside protruding pole, said insert end of said press component being inserted into said upper trough, said block device being inserted into said lower trough, said block device having a spring extending between said block end and one of said inside protruding pole and said outside protruding pole, said inside protruding pole and said outside protruding pole being inserted into the troughs of said strap clasp, said press component and said block end partially extending into said insert trough.

3. The buckle fastening device of claim 1, further comprising:

a press component having an insert end, said press component connected to a block device, said block device having a block end and an inside protruding pole and an outside protruding pole, said strap clasp having a bottom with an end with a pair of elongated troughs, said block device having a spring extending between said block end and one of said protruding poles, said protruding poles being urged by said spring into said upper and lower troughs of said strap clasp, said press component and said block end partially extending into said insert trough.

4. The buckle fastening device of claim 1, said inert ends of said strap clasp being movable through said bottom rim of said insert trough.

5. A buckle fastening device for luggage comprising:

a strap clasp having an insert end with elastic propping parts at both sides thereof;

a main casing having a hollow trough, said main casing having an expanded plate at a top thereof, said expanded plate having an insert trough opening to said hollow trough, said insert trough having a bottom rim through which said hollow trough extends;

a prop block set within said hollow trough of said main casing, said prop block having a top plate fit into said hollow trough of said main casing;

a spring positioned between said prop block and a base plate of said main casing, said spring urging said prop block upwardly toward a bottom of said strap clasp; and a base casing having an inner groove receiving a bottom of said main casing, said base casing having an expanded rim at a top thereof, said base casing having said base plate with a bore therein, said base plate of said base casing aligned with said base plate of said main casing, the insert end of said strap clasp having the elastic propping parts being pressed inwardly and said insert trough being blocked when said strap clasp is inserted directly downwardly into said insert trough of said main casing, said prop block having an arcuate top plate with a hooked protruding pole at a bottom thereof.

6. A buckle fastening device for luggage comprising:

a strap clasp having an insert end with elastic propping parts at both sides thereof;

a main casing having a hollow trough, said main casing having an expanded plate at a top thereof, said expanded plate having an insert trough opening to said hollow trough, said insert trough having a bottom rim through which said hollow trough extends;

a prop block set within said hollow trough of said main casing, said prop block having a top plate fit into said hollow trough of said main casing;

a spring positioned between said prop block and a base plate of said main casing, said spring urging said prop block upwardly toward a bottom of said strap clasp; and a base casing having an inner groove receiving a bottom of said main casing, said base casing having an expanded rim at a top thereof, said base casing having said base plate with a bore therein, said base plate of said base casing aligned with said base plate of said main casing, the insert end of said strap clasp having the elastic propping parts being pressed inwardly and said insert trough being blocked when said strap clasp is inserted directly downwardly into said insert trough of said main casing, said main casing having a pair of vertical guide channels on both sides thereof, said prop block having hooked protruding poles, said pair of vertical guide channels receiving said hooked protruding poles therein.

7. The buckle fastening device of claim 6, said spring urging against said top plate of said prop block.

* * * * *